US005304040A

United States Patent [19]

Wang

[11] Patent Number: 5,304,040

[45] Date of Patent: Apr. 19, 1994

[54] TRI-POD PORTABLE FAN

[75] Inventor: Jui-Shang Wang, Taipei, Taiwan

[73] Assignee: Duracraft Corporation, Sudbury, Mass.

[21] Appl. No.: 726,676

[22] Filed: Jul. 8, 1991

[51] Int. Cl.[5] ..... F01D 25/00

[52] U.S. Cl. ..... 416/247 R; 416/246; 248/188.2

[58] Field of Search ..... 416/247 R, 63, 246; 248/188.2

[56] References Cited

U.S. PATENT DOCUMENTS

| | | | |
|---|---|---|---|
| D. 323,708 | 2/1992 | Wang | 416/247 R |
| 2,281,769 | 5/1942 | Hochriem | 248/188.2 |
| 2,476,692 | 7/1949 | Bernstein | 416/246 |
| 2,544,281 | 3/1951 | Seil | 416/247 |
| 2,600,325 | 6/1952 | Reisch | 416/100 |
| 2,857,095 | 10/1958 | Suarez et al. | 416/246 |
| 3,927,853 | 12/1975 | Guth | 248/188.2 |
| 4,925,137 | 5/1990 | Hastings | 248/188.2 |
| 4,927,324 | 5/1990 | Coup et al. | 416/247 |
| 5,131,810 | 7/1992 | Wang | 416/247 R |

FOREIGN PATENT DOCUMENTS

| | | | |
|---|---|---|---|
| 232110 | 1/1961 | Australia | 416/247 R |
| 447853 | 7/1927 | Fed. Rep. of Germany | 416/247 |
| 648604 | 8/1937 | Fed. Rep. of Germany | 416/247 |
| 606288 | 7/1960 | Italy | 416/246 |
| 135792 | 10/1981 | Japan | 416/247 R |
| 68595 | 4/1982 | Japan | 416/100 |
| 179523 | 11/1982 | Japan | 416/247 R |
| 210291 | 9/1987 | Japan | 416/246 |
| 80509 | 9/1918 | Switzerland | 248/188.2 |
| 518642 | 3/1940 | United Kingdom | 248/188.2 |

*Primary Examiner*—John T. Kwon
*Attorney, Agent, or Firm*—Pennie & Edmonds

[57] ABSTRACT

An air blower including a rear housing defining a plurality of air inlet openings; a front housing having an annular peripheral portion secured to the rear housing, a central support portion within the peripheral portion and including a rear surface facing the rear housing and an oppositely directed front surface, and a grillwork portion extending between the peripheral portion and the support portion; and a fan assembly secured to the rear surface and projecting toward the rear housing, the fan assembly including an electrical motor and a fan blade rotatably coupled therewith, an electrical switch operatively connected to the motor, and an actuator operatively coupled to the electrical switch and projecting outwardly from the front surface. Mounting of the fan assembly on the central support portion simplifies assembly and minimizes external size of the blower.

14 Claims, 2 Drawing Sheets

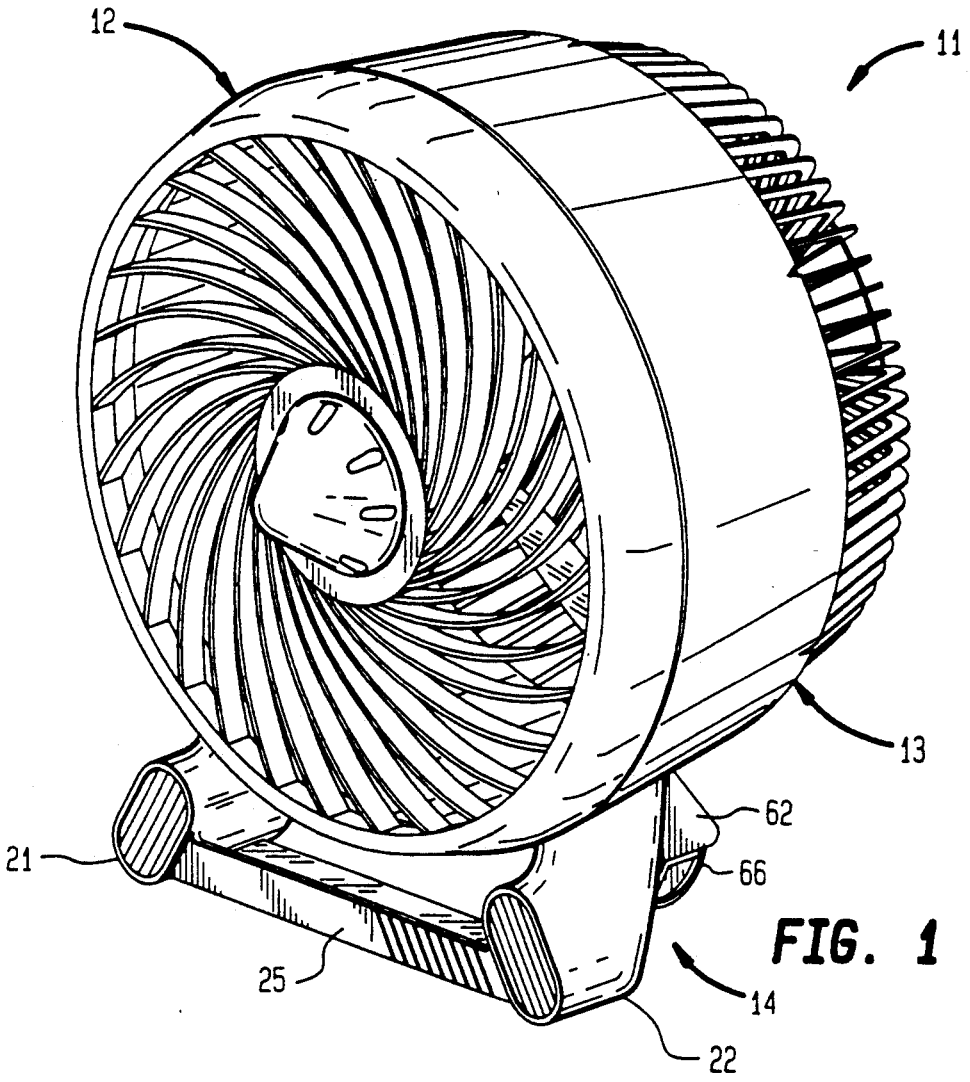
FIG. 1
FIG. 4
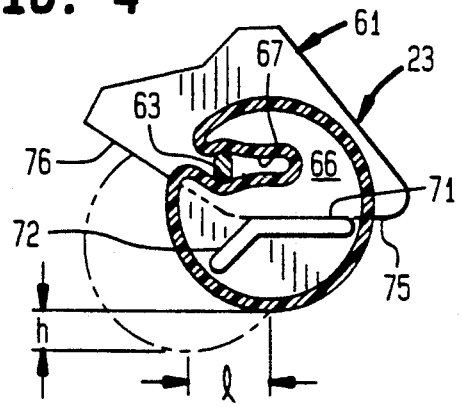

TRI-POD PORTABLE FAN

BACKGROUND OF THE INVENTION

This invention relates generally to a portable electrical fan and, more particularly, to a versatile, easily manufactured, and low cost portable electrical fan.

Portable electrical fans are utilized to create air flow and thereby enhance environmental conditions. To optimize the flow patterns produced thereby, many portable fans are provided with supports that permit selective orientation of a fan member on a supporting pedestal. Although various types of fan supports have been proposed, prior support mechanisms suffer from a number of individual and collective disadvantages such as high cost, cumbersome adjustment requirements, excessive size, insufficient orientation adjustment capability, etc.

The object of this invention, therefore, is to provide an improved portable electrical fan that is inexpensive, easily assembled, and can be easily transported to a position and adjusted to provide a desired air flow orientation.

SUMMARY OF THE INVENTION

The invention is an air blower including a rear housing defining a plurality of air inlet openings; a front housing having an annular peripheral portion secured to the rear housing, a central support portion within the peripheral portion and including a rear surface facing the rear housing and an oppositely directed front surface, and a grillwork portion extending between the peripheral portion and the support portion; and a fan assembly secured to the rear surface and projecting toward the rear housing, the fan assembly including an electrical motor and a fan blade rotatably coupled therewith, an electrical switch operatively connected to the motor, and an actuator operatively coupled to the electrical switch and projecting outwardly from the front surface. Mounting of the fan assembly on the central support portion simplifies assembly and minimizes external size of the blower.

According to features of the invention, the rear housing further defines a chamber, a substantially circular access opening thereto, the fan assembly projects through the access opening into the chamber, the peripheral portion includes a substantially circular rim engaging the access opening which is covered by the front housing. This arrangement further optimizes the external configuration of the blower.

According to another feature of the invention, the grillwork portion comprises a plurality of curved vanes extending between the rim and the central support portion. The curved vanes enhance the selection of a desired air discharge pattern.

According to other features of the invention, the front housing and the rear housing are integrally molded units. These features reduce cost and further simplify assembly of the blower.

According to another feature , the invention includes a power cord connected to the electrical switch and the front housing means further defines a channel opening toward the chamber and retaining a portion of a power cord connected to the switch. The channel provides a conveniently located protective housing for the power cord.

According to yet other features, the blower further comprises a base including a downwardly projecting handle and adapted to support the blower on a support surface. Combining a base and downwardly projecting handle enhances the compact external configuration of the blower.

According to other features of the invention, the base comprises only three legs, one of the legs is disposed in a plane bisecting the other two legs, a cross member extending between the other two legs forms the handle, and the blower includes an orientation adjustment mechanism for the one leg. The adjustment mechanism permits selective changes in the orientation of the blower to establish desired air discharge patterns.

According to further features of the invention, the adjustment mechanism is operable to change the length of the one leg, and the spacing between the one leg and the other two legs. This arrangement facilitates the selective orientation of the blower.

According to additional features of the invention, the one leg comprises a pair of spaced apart brackets retaining a pivot pin, and the adjustment mechanism comprises a rotary member disposed between the brackets, having an eccentric hole rotatably coupled to the pivot pin and adapted to engage the support surface, and defining rotation limiting stop surfaces for engaging the brackets to limit rotation of the rotary member on the pivot pin. Selective orientation of the blower is provided by rotation of the rotary member between the limits established by the stop surfaces.

DESCRIPTION OF THE DRAWINGS

These and other objects and features of the invention will become more apparent upon a perusal of the following description taken in conjunction with the accompanying drawings wherein:

FIG. 1 is a perspective view of a portable fan according to the invention;

FIG. 4 is a partial cross-sectional view showing an adjustable leg on the fan shown in FIGS. 1–3.

DESCRIPTION OF THE PREFERRED EMBODIMENT

Figure 2:
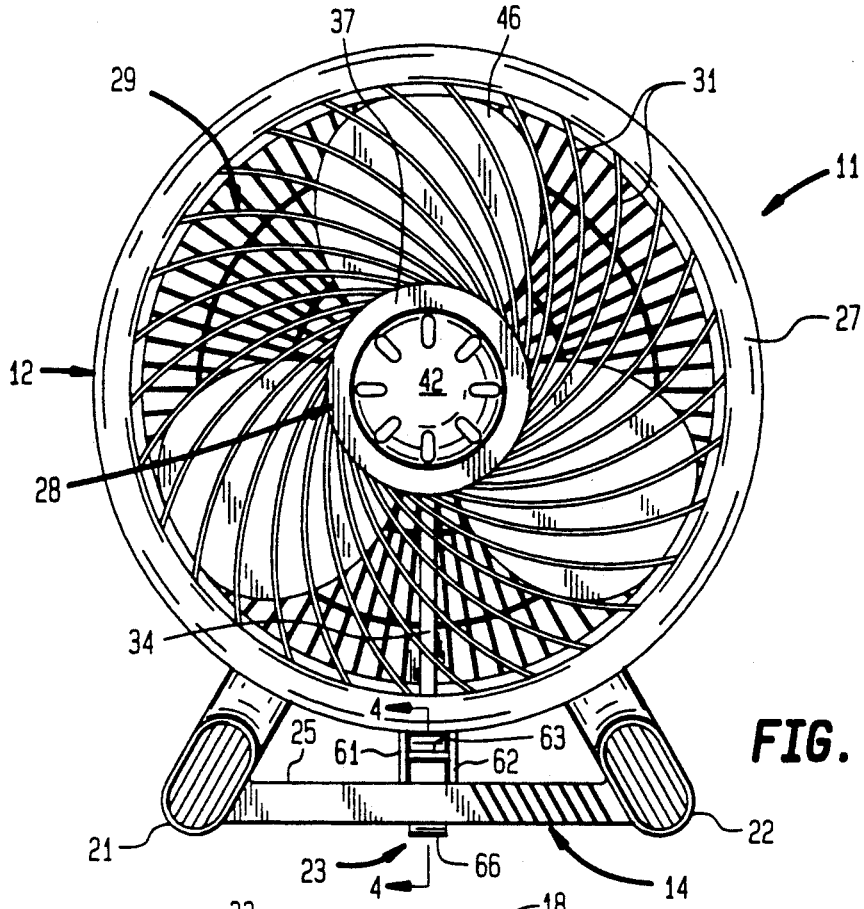
FIG. 2 is a front view of the fan shown in FIG. 1.

An air blower 11 according to the present invention includes a front housing 12, a rear housing 13 and base 14. The rear housing 13 defines a chamber 16 and a plurality of rearwardly facing inlet openings 17. Also defined by the rear housing 13 is a circular opening 18 providing access to the chamber 16.

The base 14 includes a pair of front legs 21, 22 projecting downwardly from a front portion of the rear housing 13 and a rear leg 23 projecting downwardly from a rear portion thereof. Extending between the front legs 21, 22 is a cross member 25 that is spaced from the front housing 12 and the rear housing 13 so as to form a handle for the blower 11. The rear leg 23 is spaced rearwardly from the front legs 21, 22 and disposed in a bisecting plane therebetween. Thus, the front legs 21, 22 and the rear leg 23 form a tri-pod for supporting the blower 11 on a suitable support surface (not shown). Preferably, the rear housing 13 and the base 14 are formed as an integrally molded unit.

Figure 3:
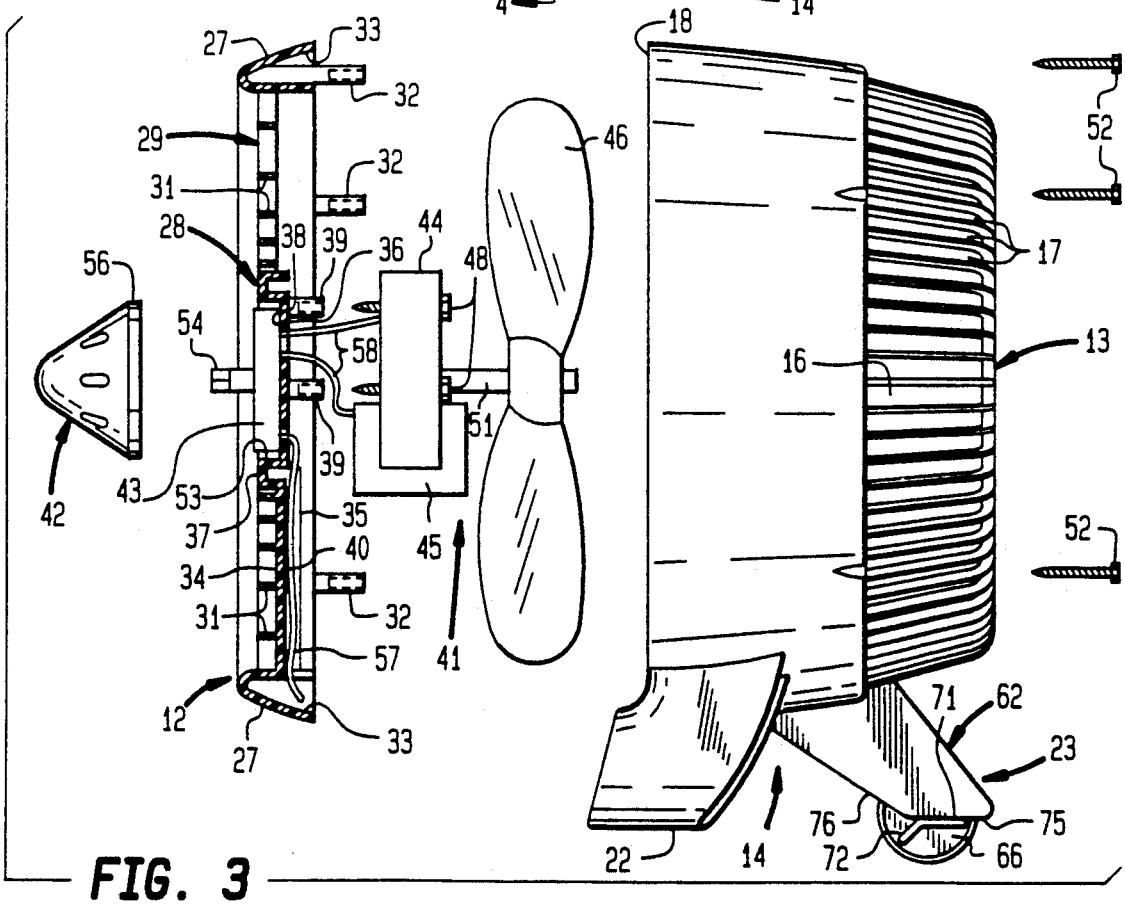
FIG. 3 is an exploded view, partially in section of the portable fan shown in FIGS. 1 and 2.

The front housing 12 includes an annular peripheral rim portion 27, conforming to the circular access opening 18 in the rear housing 13, a centrally located support portion 28 and a grillwork portion 29 extending therebetween. Forming the grillwork portion 29 are a plurality of curved vanes 31 having opposite ends attached, respectively, to the rim portion 27 and the central support portion 28. A plurality of internally threaded studs 32 project rearwardly from a trough 33 formed by the rim portion 27 as shown in FIG. 3. Also formed by the front housing 12 are a front wall 34 and side walls 35 that extend between the central support portion 28 and the trough 33 so as to form a rearwardly opening channel 40. The central support portion 28 includes a rear surface 36 facing the rear housing 13 and an oppositely directed front surface 37. Formed by the front surface 37 is a circular cavity 38. A plurality of internally threaded studs 39 extend rearwardly from the rear surface 36. Preferably, the front housing 12 also is formed as an integrally molded unit.

A fan assembly 41 (FIG. 3) is supported by the central support portion 28 of the front housing 12. Included in the fan assembly 41 is an actuator knob 42, a conventional electrical rotary switch 43, an electrical motor 44, a transformer 45 and a fan blade 46. The transformer 45 is attached to the electrical motor 44 and that unit is secured by screws 48 to the rearwardly projecting studs 39 on the central support portion 28. A drive shaft 51 rotatably couples the motor 44 to the fan blade 46 which projects into the chamber 16 formed by the rear housing 13. Securing the rear housing 13 to the front housing 12 are a plurality of screws 52 which engage the internally threaded studs 32.

The electrical switch 43 is retained within the cavity 38 in the central support portion 28 and defines therewith an annular recess 53. Projecting forwardly from the electrical switch 43 is an actuator shaft 54. Keyed for rotation with the actuator shaft 54 is the actuator knob 42 which projects forwardly from the central support portion 28 of the front housing 12. A rearwardly extending circular flange portion 56 of the actuator knob 42 is received by the annular recess 53 formed between the central support portion 28 and the electrical switch 43. Connected to the electrical switch 43 and extending through the channel 40 is a power cord 57. A plurality of electrical wires 58 connect the electrical switch 43 to the motor 44 and the transformer 45.

The rear leg 23 is formed by a pair of spaced apart brackets 61, 62 that project downwardly from the rear portion of the rear housing 13. Extending between the brackets 61, 62 is an elliptically shaped pivot pin 63. Retained by the pivot pin 63 between the brackets 61, 62 is a rotatable, circular disk member 66. As shown in FIG. 4, the disk member 66 defines an eccentric hole 67 that accommodates the pivot pin 63. Projecting transversely from opposite sides of the disk member are a first pair of ridges 71. Also projecting transversely from opposite sides of the disk member 66 and intercepting the first ridges 71 are a second pair of ridges 72. Rotation of the disk member 66 on the pivot pin 63 in one sense is limited by engagement between the stop surfaces formed by the first ridges 71 and first stop surfaces formed by bottom edges 75 of the brackets 61, 62. Similarly, rotation of the disk member 66 in the opposite sense is limited by engagement between the stop surfaces formed by the second ridges 72 and second stop surfaces formed by the forwardly facing edges 76 of the brackets 61, 62.

OPERATION

During use, the air blower 11 is easily transported to a location in which air circulation is desired. Transportation is accomplished by merely gripping the cross member handle 25 and moving the air blower 11 to the desired location. Once a suitable position is attained, the readily accessible actuator knob 42 can be rotated to actuate the switch 43 and energize the electrical motor 44, thereby producing rotation of the fan blade 46. That rotation draws air inwardly through the inlet openings 17 in the rear housing 13 for discharge through the grillwork 29 in the front housing 12. As air is discharged through the grillwork 29, aerodynamic flow is enhanced by the conical shape of the actuator knob 42 with its outwardly facing apex.

When in an established position, vertical orientation of air flow produced by the blower 11 can be adjusted easily by rotation of the disk member 66 on the pivot pin 63. As the disk member 66 is rotated on the pin 63 between the position shown by solid lines in FIG. 4 with the first ridges 71 engaging the bottom edges 75 of the brackets 61, 62 to the position shown by dashed lines with the second ridges 72 engaging the front edges 76 of the brackets 61, 62; the effective length of the rear leg 23 is changed by a distance h and the spacing thereof from the front legs 21, 22 is changed by a distance 1. Consequently, the tilt of the air blower 11 is changed and the orientation of air flow produced thereby is altered accordingly. Frictional engagement between the eccentric hole 67 in the disk member 66 and the pivot pin 63 will retain the disk member 66 in any desired angular position between those illustrated in FIG. 4 to thereby establish any of a variety of desired orientations for the blower 11.

Obviously, many modifications and variations of the present invention are possible in light of the above teachings. It is to be understood, therefore, that the invention can be practiced otherwise than as specifically described.

What is claimed is:

1. An air blower comprising:

rear housing means defining a plurality of air inlet openings;

front housing means comprising an annular peripheral portion secured to said rear housing means, a central support portion within said peripheral portion and including a rear surface facing said rear housing means and an oppositely directed front surface, and a grillwork portion extending between said peripheral portion and said support portion;

a fan assembly secured to said rear surface and projecting toward said rear housing means, said fan assembly comprising an electrical motor and a fan blade rotatably coupled therewith, an electrical switch operatively connected to said motor, and an actuator operatively coupled to said electrical switch;

a base means adapted to support said air blower on a support surface, said base means comprising three legs, one of said legs comprising a stem portion having a pair of spaced apart brackets and a pivot means comprising a pivot pin extending between said brackets; and adjustment means comprising a rotary member having an eccentric hole rotatably coupled to said pivot means and adapted to engage the support surface, said rotary member being disposed between said brackets and defining rotation limiting stop surfaces adapted for engagement therewith for selectively altering the orientation of said blower and for changing the spacing between said one leg and the other two of said three legs.

2. An air blower according to claim 1 wherein each of said front housing means and said rear housing means is an integrally molded unit.

3. An air blower according to claim 1 including power cord means connected to said electrical switch and wherein said front housing means further comprises a channel opening toward said chamber and retaining a portion of said power cord means.

4. An air blower according to claim 1 wherein said adjustment means is operable to change the length of said one leg.

5. An air blower according to claim 1, wherein said base means further includes a cross member extending between said other two legs and spaced from said front and rear housing means to form a handle.

6. An air blower according to claim 1 wherein said rear housing means further defines a chamber and an access opening thereto, said fan assembly projects through said access opening into said chamber; and said access opening is covered by said front housing means.

7. An air blower according to claim 5 wherein said base means is attached to said rear housing means.

8. An air blower according to claim 6 wherein said base means and said rear housing means are formed as an integrally molded unit.

9. An air blower according to claim 1 wherein said actuator comprises a conically shaped knob having an apex projecting away from said front surface.

10. An air blower according to claim 6 wherein said access opening is substantially circular and said annular peripheral portion is a substantially circular rim.

11. An air blower according to claim 10 wherein said grillwork portion comprises a plurality of curved vanes extending between said rim and said central support portion.

12. An air blower comprising:

housing means defining a plurality of air inlet openings and a grillwork;

fan assembly means retained within said housing means and energizable to induce air flow in through said inlet openings and out through said grillwork;

base means projecting below said housing means and adapted to provide support thereof on a support surface, said base means comprising only three legs adapted to engage the support surface; and adjustment means for selectively changing both the length of one said leg and the spacing thereof from the other said legs.

13. An air blower according to claim 12 wherein said one leg comprises a stem portion having a pivot means, and said adjustment means comprises a rotary member having an eccentric hole rotatably coupled to said pivot means and adapted to engage the support surface.

14. An air blower according to claim 13 wherein said stem portion comprises a pair of spaced apart brackets, said pivot means comprises a pivot pin extending between said brackets, said rotary member is disposed between said brackets and defines rotation limiting stop surfaces adapted for engagement therewith.

* * * * *